US012590710B2

(12) United States Patent
Okumura et al.

(10) Patent No.: US 12,590,710 B2
(45) Date of Patent: Mar. 31, 2026

(54) LINKED HOT WATER SUPPLY SYSTEM

(71) Applicant: NORITZ CORPORATION, Hyogo (JP)

(72) Inventors: Kazuaki Okumura, Hyogo (JP); Mitsumasa Shiba, Hyogo (JP); Shinsuke Hashimoto, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 425 days.

(21) Appl. No.: 18/166,451

(22) Filed: Feb. 8, 2023

(65) Prior Publication Data

US 2023/0266020 A1 Aug. 24, 2023

(30) Foreign Application Priority Data

Feb. 22, 2022 (JP) ..... 2022-025556

(51) Int. Cl.
*F24D 19/10* (2006.01)

(52) U.S. Cl.
CPC ..... *F24D 19/1006* (2013.01)

(58) Field of Classification Search
CPC ..... F24H 15/215; F24H 15/10; F24H 15/219; F24H 15/365; F24H 9/2035; F24H 15/238; F24D 19/1051; F24D 19/1006; F24D 17/0026; F24D 2200/043
USPC ..... 122/14.3
See application file for complete search history.

(56) References Cited

U.S. PATENT DOCUMENTS 7,628,123 B2 * 12/2009 Inami ..... F24D 12/02 122/448.3
2022/0121229 A1 * 4/2022 Hobbs ..... G01M 3/2876

FOREIGN PATENT DOCUMENTS

JP 4448263 4/2010

* cited by examiner

*Primary Examiner* — Steven B Mcallister
*Assistant Examiner* — John E Bargero
(74) *Attorney, Agent, or Firm* — JCIPRNET

(57) ABSTRACT

A linked hot water supply system includes: multiple combustion hot water supply devices arranged in parallel between a water supply pipe and a hot water supply pipe; and a control means, changing a number of operated units of the hot water supply devices to adjust a heating capacity according to a hot water consumption. The hot water supply devices each includes a water passing volume detection means detecting a water passing volume of tap water introduced from the water supply pipe and an inlet water filter installed to an introduction part of the tap water from the water supply pipe. If the hot water supply devices are operating at a same time, the control means makes a determination on blockage of the inlet water filter installed in each of the hot water supply devices by comparing the water passing volumes of the hot water supply devices in operation.

3 Claims, 5 Drawing Sheets

LINKED HOT WATER SUPPLY SYSTEM

CROSS-REFERENCE TO RELATED APPLICATION

This application claims the priority benefit of Japanese Application Serial No. 2022-025556, filed on Feb. 22, 2022. The entirety of the above-mentioned patent application is hereby incorporated by reference herein and made a part of this specification.

BACKGROUND

Technical Field

The invention relates to a linked hot water supply system including multiple hot water supply devices and a system control device controlling the number of operating units of the hot water supply devices, and, in order to adjust the heating capacity in accordance with a hot water consumption, changing the number of operating units to supply hot water.

Description of Related Art

Conventionally, as a general household hot water supply device, a combustion hot water supply device adjusting the heating capacity to supply hot water, so as to be able to supply hot water at a set target temperature is used. The heating capacity of the hot water supply device is changed/adjusted in accordance with the temperature of tap water guided to the hot water supply device, a target temperature, and a hot water outlet flow rate (water passing volume). For example, in the case where the heating capacity is insufficient because the target temperature is high, the hot water outlet flow rate is reduced, and the hot water at the set target temperature is preferentially supplied.

Meanwhile, in dormitories, lodging facilities, sports gyms, etc., a large amount of hot water supply may be required because of concentrated hot water usage for the purpose of showering of multiple users. Therefore, a linked hot water supply system formed by multiple combustion hot water supply devices is used. The linked hot water supply system supplies hot water at the set target temperature to a hot water supply pipe, and a hot water user uses hot water at a desired temperature from a hot water supply tap with a temperature adjustment function.

The linked hot water supply system adjusts the heating capacity of an operating hot water supply device in operation in accordance with the hot water consumption (the hot water outlet flow rate of the hot water at the target temperature), and changes the number of operating units of the hot water supply devices. Therefore, the linked hot water supply system is able to cope with supplying a small amount of hot water with one operating unit, in addition to supplying a large amount of hot water. The number of operating units of the hot water supply devices, for example, is changed one by one, in the case where a predetermined additional operation condition or operation stop condition is satisfied, for example.

The multiple hot water supply devices of the linked hot water supply system each includes a water inlet filter capturing a foreign matter flowing with tap water in an introduction part of tap water. In the case of a partial blockage due to the foreign matter captured by the water inlet filter, the water passing volume of the hot water supply device is reduced, and the hot water at the target temperature cannot be supplied at a sufficient flow rate. Regarding the measure at the time of such blockage, although not related to a hot water supply device, Patent Document 1 discloses, as an example, a device able to solubilizing sludge, which includes two supply paths, each including a filter and a pump, and is configured to determine the flow path as being blocked when the flow rate of one of the supply paths is low at the time of driving of the pump and switch to the other supply path.

PRIOR ART DOCUMENTS

Patent Documents

[Patent Document 1] Japanese Patent No. 4448263

A combustion hot water supply device starts operating when the flow rate of tap water to be heated is equal to or greater than a predetermined operation start flow rate, and adjusts a heating capacity in accordance with the temperature of the tap water that is introduced therein, a target temperature, and a hot water outlet flow rate to supply hot water. In the linked hot water supply system including multiple combustion hot water supply devices, it is possible to switch the operating hot water supply device to switch the flow path.

However, since the hot water outlet flow rate (water passing volume) of the operating hot water supply device changes with hot water consumption, it is difficult to make a determination on the blockage of the water inlet filter in accordance with a decrease in flow rate as in Patent Document 1. In addition, since it is difficult to increase the flow rate of the tap water to be heated in a hot water supply device whose water inlet filter is blocked to a certain extent, there is a concern that issues such as a delayed start of operation or the inability to satisfy an additional operation condition may occur. Furthermore, in the case where the hot water supply device that is first operated is the hot water supply device in which the blockage of the water inlet filter is in progress, there is a concern that such hot water supply device cannot reach the predetermined operation start flow rate, and other hot water supply devices cannot be operated as well. As a result, hot water cannot be supplied.

SUMMARY

An aspect of the invention provides a linked hot water supply system. The linked hot water supply system includes multiple combustion hot water supply devices arranged in parallel between a water supply pipe and a hot water supply pipe; and a control means, changing a number of operated units of the hot water supply devices to adjust a heating capacity in accordance with a hot water consumption. The hot water supply devices is each provided with a water passing volume detection means which detects a water passing volume of tap water introduced from the water supply pipe and an inlet water filter installed to an introduction part of the tap water from the water supply pipe. In a case where the hot water supply devices are operating at a same time, the control means makes a determination on blockage of the inlet water filter installed in each of the hot water supply devices by comparing the water passing volumes of the hot water supply devices in operation.

Figure 4:
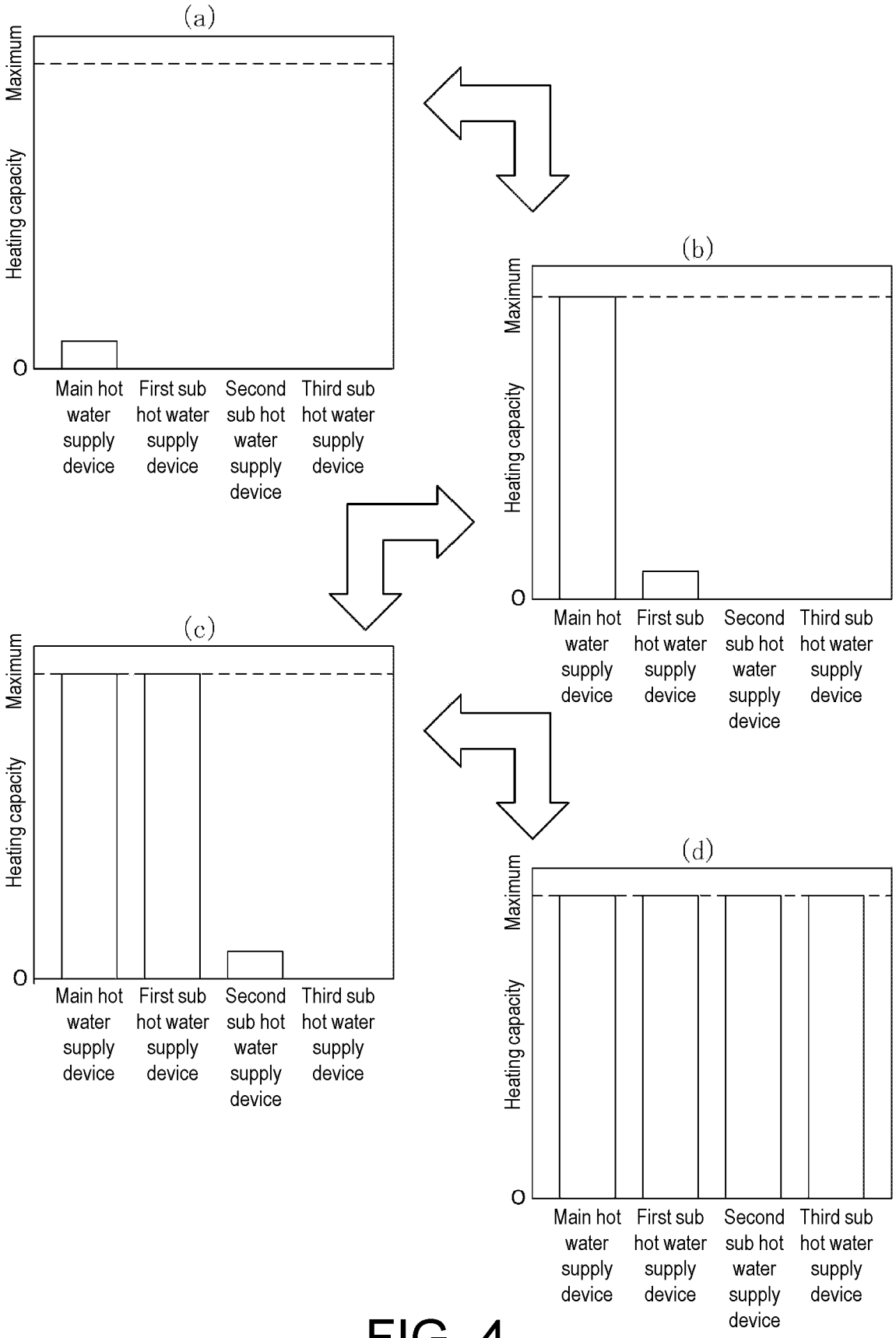

(a) to (d) of FIG. 4 are schematic diagrams illustrating the transition of heating capacity according to the embodiment.

Figure 5:
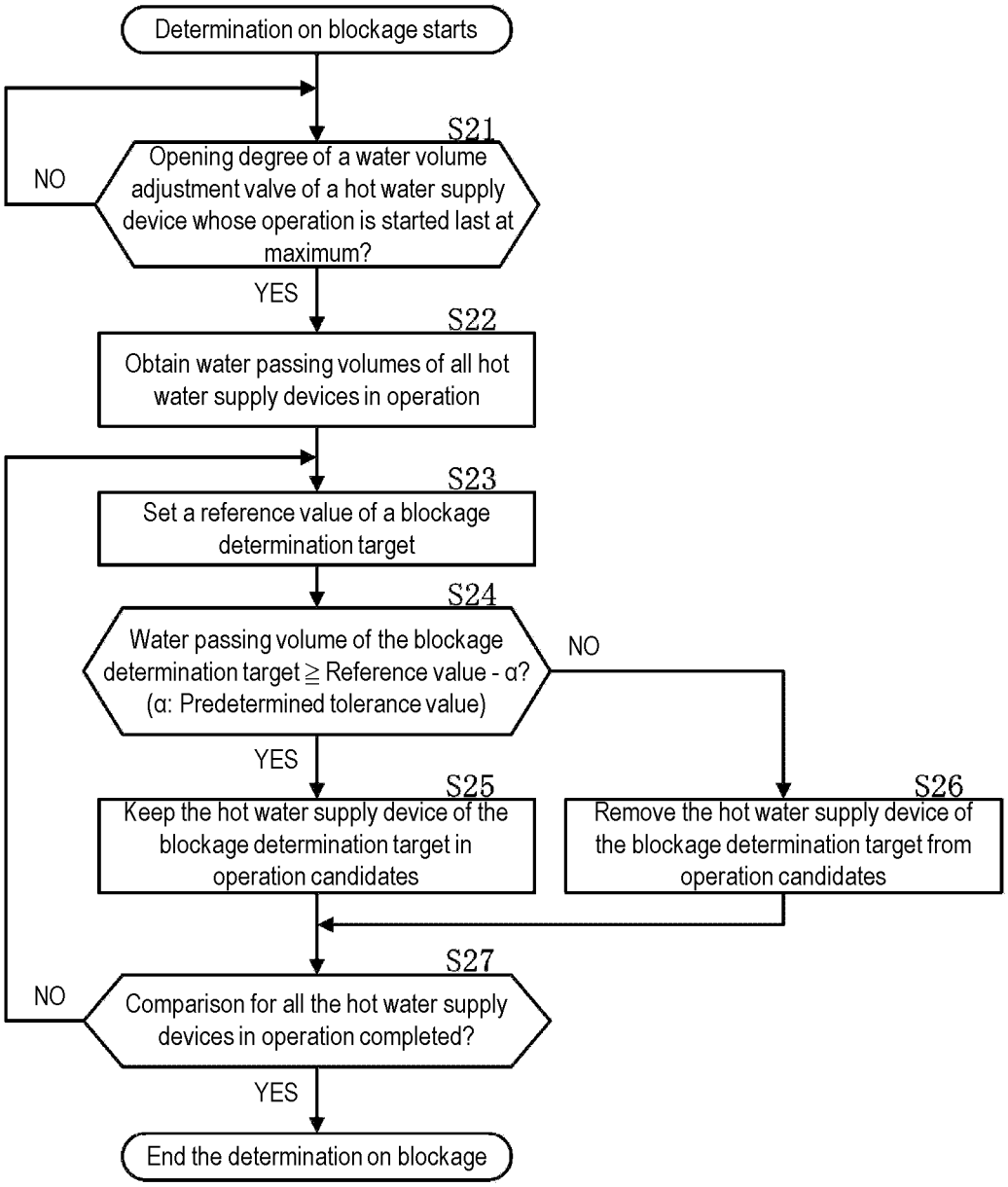

FIG. 5 is a flowchart illustrating making a determination on blockage of a water inlet filter according to the embodiment.

DESCRIPTION OF THE EMBODIMENTS

The invention provides a linked hot water supply device capable of making a determination on blockage of a water inlet filter.

A linked hot water supply system according to an aspect of the invention includes: a plurality of combustion hot water supply devices arranged in parallel between a water supply pipe and a hot water supply pipe; and a control means, changing a number of operated units of the hot water supply devices to adjust a heating capacity in accordance with a hot water consumption. The hot water supply devices is each provided with a water passing volume detection means which detects a water passing volume of tap water introduced from the water supply pipe and an inlet water filter installed to an introduction part of the tap water from the water supply pipe. In a case where the hot water supply devices are operating at a same time, the control means makes a determination on blockage of the inlet water filter installed in each of the hot water supply devices by comparing the water passing volumes of the hot water supply devices in operation.

According to the configuration, by comparing the water passing volumes of the hot water supply devices operating at the same time, the control means can determine that the inlet water filter installed to the introduction part of tap water is blocked for a hot water supply device whose water passing volume is small.

Regarding the linked hot water supply system of an embodiment of the invention, in the linked hot water supply system, the hot water supply devices each have a water volume adjustment means which adjusts the water passing volume during operation. In a case where an opening degree of the water volume adjustment means of a hot water supply device which is last operated among the hot water supply devices in operation is at maximum, the control means compares the water passing volumes of the hot water supply devices in operation.

According to the configuration, the hot water supply devices of the linked hot water supply system each include the water volume adjustment means. Among the hot water supply devices in operation at the same time, in the case where the opening degree of the water volume adjustment means of the hot water supply device whose operation is started last is at the maximum, since the opening degrees of the water volume adjustment means of all the hot water supply devices in operation are at the maximum, the water passing volumes of the hot water supply devices in operation should be equal. By using this point, a determination on the blockage of the inlet water filters can be made for the hot water supply devices in operation at the same time by comparing the water passing volumes.

Regarding the linked hot water supply system of an embodiment of the invention, in the linked hot water supply system, the control means excludes a hot water supply device in which the inlet water filter is determined as blocked among the hot water supply devices from operation candidates.

According to the configuration, since the hot water supply device whose water inlet filter is determined as blocked is not operated, an issue due to blockage of the water inlet filter can be prevented from occurring. In addition, it is possible to maintain the hot water supply device whose inlet water filter is blocked without interfering with other hot water supply devices.

According to the linked hot water supply system according to the invention, since the blockage of the water inlet filter can be determined, it is possible to prompt maintenance of the hot water supply device whose water inlet filter is determined as blocked, and prevent an issue due to blockage of the water inlet filter from occurring.

Hereinafter, the modes for implementing the invention are demonstrated based on the embodiments.

EMBODIMENT

Figure 1:
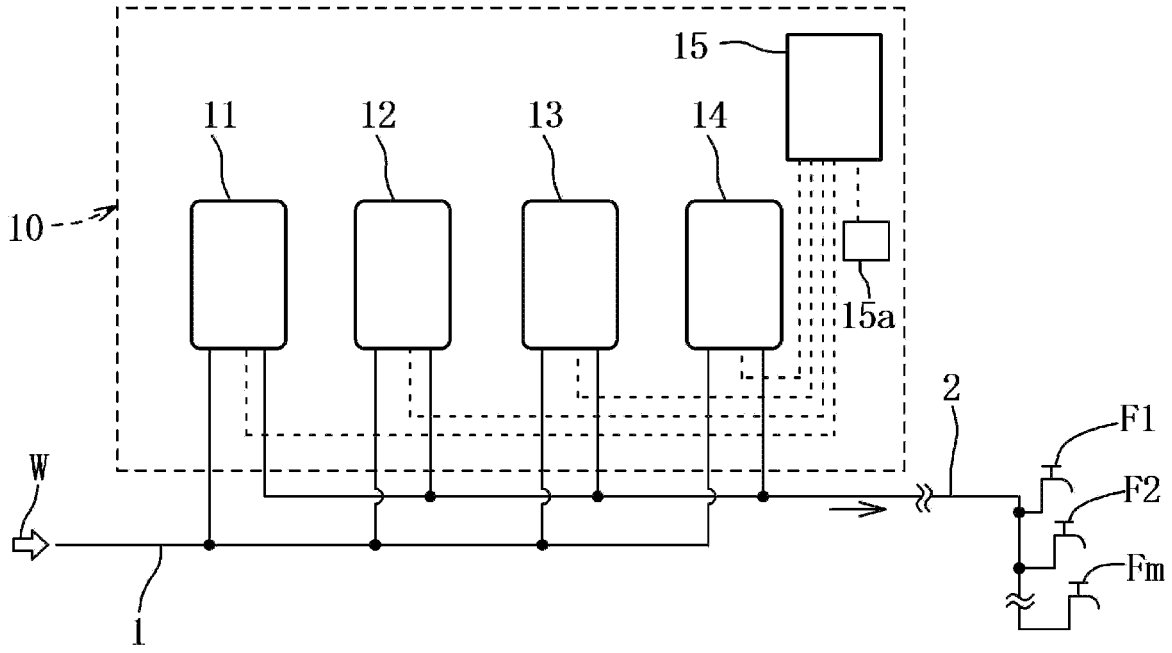
FIG. 1 is view illustrating a linked hot water supply system according to an embodiment of the invention.

As shown in FIG. 1, a linked hot water supply system 10 is configured so that tap water is supplied as indicated by an arrow W in a water supply pipe 1, the tap water introduced from the water supply pipe 1 is heated to a target temperature to be supplied to a hot water supply pipe provided with multiple hot water supply taps F1 to Fm. The linked hot water supply system 10 includes multiple (four in this case) hot water supply devices 11 to 14, and a system control device 15, as a control means, in communication connection for performing operating unit number control on the hot water supply devices 11 to 14. The system control device 15 has an operation remote controller 15*a* which performs, for example, a hot water outlet temperature setting operation of the linked hot water supply system 10. The hot water supply devices 11 to 14 are arranged in parallel and connected between the water supply pipe 1 and the hot water supply pipe 2, and all of the hot water supply devices 11 to 14 can supply hot water to the hot water supply taps F1 to Fm. The hot water supply taps F1 to Fm, for example, have a function of mixing tap water to adjust the temperature, and a hot water user may make adjustment to a desired temperature. The number of units of the hot water supply devices forming the linked hot water supply system 10 is not limited to four, and it suffices as long as the number of units is equal to or greater than 2.

Figure 2:
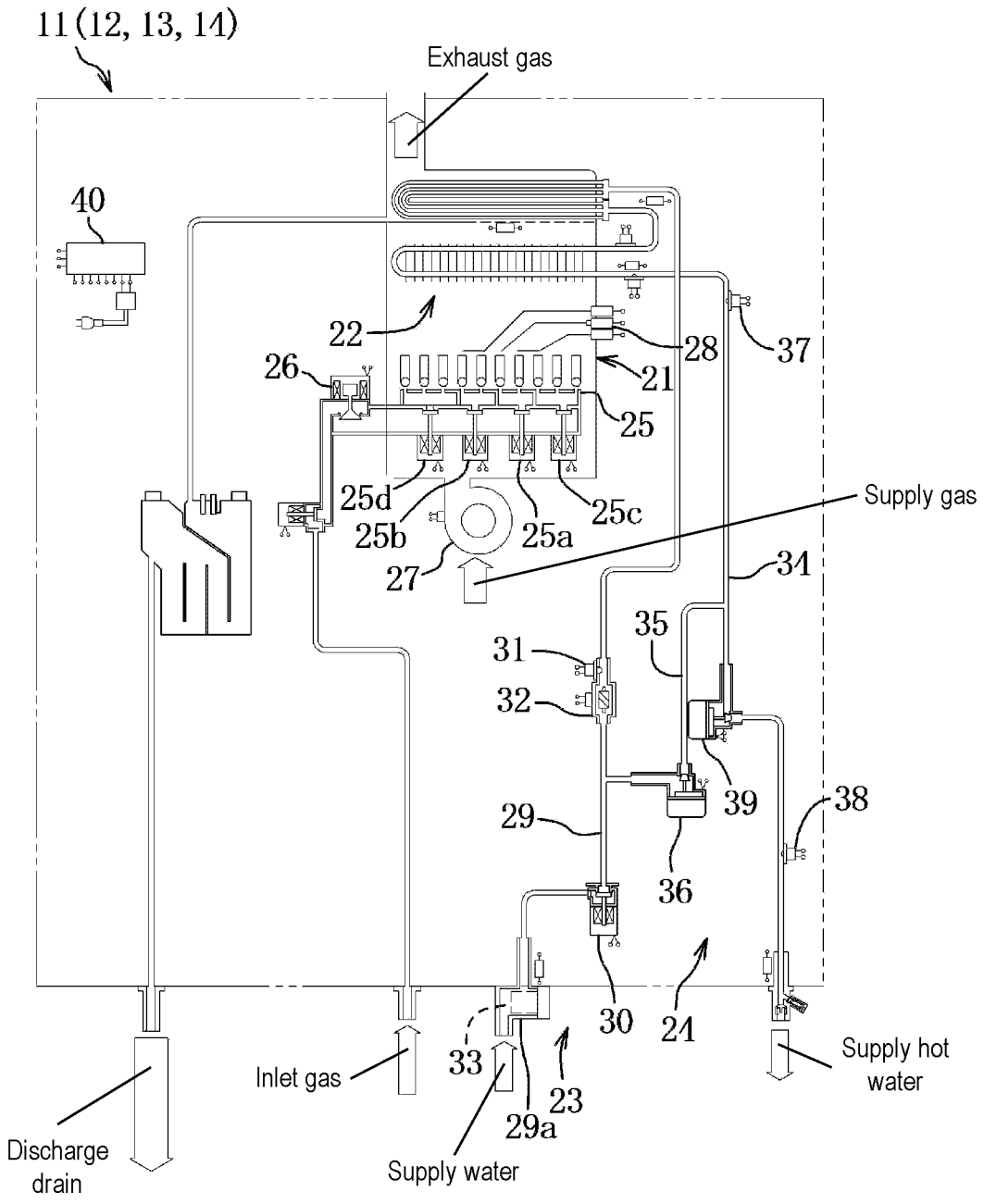
FIG. 2 is a schematic view illustrating a hot water supply device forming the linked hot water supply system according to the embodiment.

In the following, the hot water supply devices 11 to 14 are described. Since the hot water supply devices 11 to 14 have the same configuration, the description is made on the hot water supply device 11 and the description of the hot water supply devices 12 to 14 is omitted. As shown in FIG. 2, the hot water supply device 11 is a combustion hot water supply device configured to make use of the combustion heat of the fuel gas in a combustion part 21 to heat the hot water flowing through a heat exchange part 22. The hot water supply device 11 has a water supply part 23 supplying tap water to the heat exchange part 22 and a hot water outlet part 24 which adjusts the temperature of the hot water heated by the heat exchange part 22 and outlets hot water.

The combustion part 21 has a burner 25 provided with multiple combustion compartments, a fuel adjustment valve 26 adjusting a supply flow rate of fuel gas to the burner 25, a combustion fan 27 supplying air for combustion, and an ignition device 28 making use electric discharge to ignite the burner 25. The burner 25 includes opening/closing valves 25*a* to 25*d* corresponding to the combustion compartments.

The water supply part 23 has a water supply path 29 connected with the water supply pipe 1 and the heat exchange part 22, a water supply valve 30 opening and closing the water supply path 29, a water supply temperature sensor 31 detecting the temperature of the tap water (water supply temperature), and a water supply flow rate sensor 32 detecting the flow rate of the tap water (water supply flow rate) supplied to the heat exchange part 22. In the water supply path 29, a water inlet filter 33 for capturing a foreign matter flowing with tap water is detachably installed to an introduction part 29*a* of the tap water from the water supply pipe 1.

The hot water outlet part 24 has a hot water outlet path 34 connected with the heat exchange part 22 and the hot water supply pipe 2, a bypass path 35 branched from the water supply path 29 on the downstream side of the water supply valve 30 to be connected to the hot water outlet path 34, and a bypass flow rate adjustment valve 36. The bypass flow rate adjustment valve 36 adjusts the flow rate of the tap water flowing from the water supply path 29 to the bypass path 35. The hot water outlet path 34 is provided with a first hot water outlet temperature sensor 37 detecting the temperature of the hot water heated by the heat exchange part 22, a second hot water outlet temperature sensor 38 detecting the temperature (hot water outlet temperature) of the hot water in which the heated hot water is mixed with the tap water from the bypass path 35 to adjust the temperature, and a hot water outlet flow rate adjustment valve 39. The hot water outlet flow rate adjustment valve 39 is a water volume adjustment means which adjusts the flow rate of the tap water introduced from the water supply pipe 1 by adjusting the hot water outlet flow rate of the hot water supplied to the hot water supply pipe 2, that is, a water volume adjustment means which adjusts the water passing volume of the hot water supply device 1.

The hot water supply device 11 has a control part 40 cooperating with the system control device 15 to control the hot water supply operation of the hot water supply device 11. The controller 40 obtains the detected flow rate of the water supply flow rate sensor 32 and the detected temperature of each of the water supply temperature sensor 31, the first hot water outlet temperature sensor 37, and the second hot water outlet temperature sensor 38. In addition, based on the detected flow rate and the detected temperatures, the control part 40 changes and adjusts the heating capacity by controlling the rotation speed of the combustion fan 27, the opening degree of the fuel adjustment valve 26, and the opening and closing of the opening/closing valves 25*a* to 25*d*, and adjusts the opening degree of the bypass flow rate adjustment valve 36. Accordingly, a hot water supply operation supplying hot water at the set target temperature to the hot water supply pipe 2 is performed.

For example, in the case where the hot water consumption is high and the hot water at the target temperature cannot be supplied, the control part 40 is configured to adjust the opening degree of the hot water outlet flow rate adjustment valve 39 to lower the water passing volume, thereby being able to supply hot water at the target temperature. The water passing volume of the hot water supply device 11 is calculated by the control part 40 based on the detected flow rate of the water supply flow rate sensor 32, the opening degree of the bypass flow rate adjustment valve 36, and the opening degree of the hot water outlet flow rate adjustment valve 39. Accordingly, a water passing volume detection means detecting the water passing volume of the hot water supply device 11 is formed by the water supply flow rate sensor 32, the bypass flow rate adjustment valve 36, the hot water outlet flow rate adjustment valve 39, and the control part 40.

The system control device 15 sets one (e.g., the hot water supply device 11) of the hot water supply devices 11 to 14 that are the operation candidates of the hot water supply operation as the main hot water supply device, and sets hot water supply devices (e.g., the hot water supply devices 12 to 14) other than the main hot water supply device as sub hot water supply devices. The main hot water supply device is the hot water supply device that is operated first when hot water supply starts. The sub hot water supply device is a hot water supply device that is not operated when hot water supply starts, but is additionally operated during hot water supply. Since there is one main hot water supply device, a number N of units of the sub hot water supply devices is N=3.

At the time of setting the sub hot water supply devices, the operation priority (order of being additionally operated) of the sub hot water supply devices other than the main hot water supply device with the highest priority is set as, for example, a first sub hot water supply device, a second sub hot water supply device, a third sub hot water supply device. In addition, in order to reduce a difference in accumulated operation time, or a difference in operation load among the hot water supply devices 11 to 14, the system control device 15 performs a rotation setting that replaces the main hot water supply device and the sub hot water supply devices periodically or in accordance with the accumulated operation time, for example.

The control part 40 of the main hot water supply device sets the water supply valve 30 to an opened state, and sets the opening degree of the hot water outlet flow rate adjustment valve 39 to be fully opened, for example. The control part 40 of the sub hot water supply device sets the water supply valve 30 to a closed state, and sets the opening degree of the hot water outlet flow rate adjustment valve 39 to a predetermined opening degree (e.g., half-opened). If any of the hot water supply taps F1 to Fm is opened and the water supply flow rate of the main hot water supply device is equal to or greater than a predetermined operation start flow rate, the hot water supply operation is started by only using the main hot water supply device.

In the case where the heating capacity, for example, of the main hot water supply device becomes equal to or greater than a predetermined value to satisfy an additional operation condition, and there is still one or more sub hot water supply devices not in operation in the operation candidates, the sub hot water supply device that is not in operation and has the highest operation priority among the sub hot water supply devices is additionally operated. The introduced tap water is distributed into multiple hot water supply devices that are operating. Therefore, the system control device 15, for example, adjusts the opening degree of the hot water outlet flow rate adjustment valve 39 of the hot water supply device whose operation is last started, so as to maintain the heating capacity of the hot water supply device whose operation is started earlier. The hot water outlet flow rate adjustment valve 39 of the last hot water supply device may also be adjusted so that the heating capacities of the hot water supply devices in operation are equal.

Regarding the sub hot water supply device that is additionally operated, in the case where the opening degree of the hot water outlet flow rate adjustment valve 39 is at the maximum, the heating capacity is equal to or greater than the predetermined value, and there is still one or more sub hot water supply device not in operation in the operation candidates, one further sub hot water supply device not in operation is additionally operated. In this way, for the hot water supply device last operated in the hot water supply devices in operation, in the case where the additional operation condition is satisfied and there are still operable sub hot water supply devices, the system control device 15 performs operating unit number control which additionally operates one sub hot water supply device after another to increase the heating capacity in accordance with the hot water consumption, so that the heating capacity is not insufficient.

Figure 3:
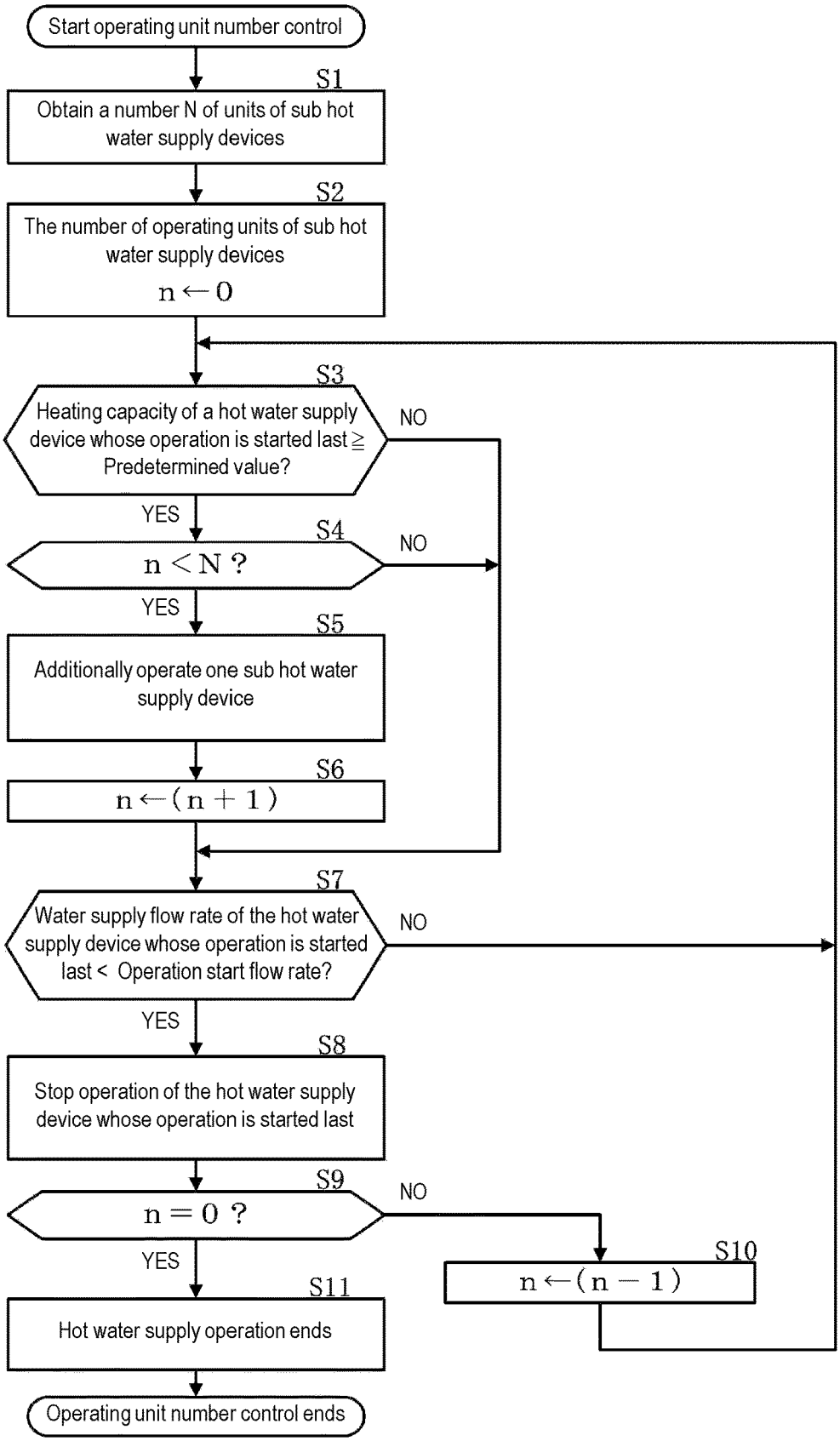
FIG. 3 is a flowchart on controlling the number of operating units according to the embodiment.

For example, when the hot water supply tap F1 is opened, and the water supply flow rate sensor 32 of the main hot water supply device detects a flow rate equal to or greater than the operation start flow rate, the main hot water supply device starts operating to perform hot water supply operation, and the operating unit number control by the system control device 15 is started. The operating unit number control is described based on the flowchart of FIG. 3. In the figure, Si (i=1, 2, . . . ) indicates Steps.

When the operating unit number control is started, in S1, the number N of units of sub hot water supply devices included in the operation candidates is obtained, and the flow proceeds to S2. In S2, since only the main hot water supply device starts operating after the hot water supply operation starts, a number n of operating units of sub hot water supply devices is set to 0, and the flow proceeds to S3.

In S3, whether the heating capacity of the hot water supply device whose operation is last started is equal to or greater than the predetermined value is determined. This is a step for determining the additional operation condition of the sub hot water supply devices. The system control device 15 respectively obtains various data related to the hot water supply operation from the control parts 40 of the hot water supply devices 11 to 14, and makes a determination on the heating capacities of the hot water supply devices 11 to 14. The hot water supply device whose operation is last started is the main hot water supply device in the case where only the main hot water supply device is operating, and, in the case where the sub hot water supply devices are also in operation, is the last (with lowest priority) sub hot water supply device whose operation is last started among the sub hot water supply devices that are operating.

In the case where the determination of S3 is YES, the flow proceeds to S4. In S4, whether the number n of operating units of sub hot water supply devices is smaller than the number N of units of sub hot water supply devices is determined. This is a step for determining whether there is a sub hot water supply device not in operation but additionally operable. In the case where the determination of S4 is YES, the flow proceeds to S5, and in S5, one sub hot water supply device not in operation is additionally operated, and the flow proceeds to S6. Then, in S6, the number n of operating units of sub hot water supply devices is added by one, and the flow proceeds to S7. At this time, the control part 40 of the sub hot water supply device receiving an additional operation command starts operating by opening the water supply valve 30 of the sub hot water supply device.

Meanwhile, in the case where the determination of S3 is NO, the flow proceeds to S7 without additionally operating a sub hot water supply device. In addition, in the case where the determination of S4 is NO, since there is no sub hot water supply device not in operation but additionally operable, the flow proceeds to S7 without additionally operating the sub hot water supply device.

In S7, whether the water supply flow rate of the hot water supply device whose operation is last started, among the hot water supply devices in operation, is less than the operation start flow rate is determined. Since the water passing volume of the hot water supply devices in operation is reduced in the case where the hot water consumption is reduced, in order to adjust the reduction, the opening degree of the hot water outlet flow rate adjustment valve 39 of the hot water supply device whose operation is last started is preferentially adjusted to reduce the heating capacity. At this time, when the water supply flow rate falls below the operation start flow rate, it is difficult to carry out the hot water supply operation stably. Therefore, this is a step for determining the operation stop condition for stopping the hot water supply device whose operation is started last.

In the case where the determination of S7 is NO, the flow proceeds to S3. In the case where the determination of S7 is YES, the flow proceeds to S8. In S8, the operation of the hot water supply device whose operation is started last is stopped, and the flow proceeds to S9. The control part 40 of the hot water supply device instructed by the system control device 15 to stop operation closes the water supply valve 30 of the hot water supply device to stop operation.

In S9, whether the number n of operating units of sub hot water supply devices is zero is determined. In the case where the determination of S9 is NO (n>0), the flow proceeds to S10. In S10, the number n of operating units of sub hot water supply devices is reduced by one, and since at least the main hot water supply device is operating, the flow returns to S3. Meanwhile, in the case where the determination of S9 is YES (n=0), since the operation of the hot water supply device is stopped in S8, the flow proceeds to S11. Then, in S11, the hot water supply operation is ended, and the operating unit number control is ended.

Then, an example of transition of the heating capacity in the hot water supply operation is described based on (a) to (d) of FIG. 4.

After the hot water supply operation is started in a state where (a) only the operation of the main hot water supply device is started, in the case where the heating capacity is increased and the main hot water supply device reaches the maximum heating capacity of the predetermined value (the additional operation condition is satisfied), one sub hot water supply device (first sub hot water supply device) is additionally operated to transition to a state of (b). Through a state of (c) where the second sub hot water supply device is additionally operated by further satisfying the additional operation condition, it is possible to additionally operate the third sub hot water supply device to increase the heating capacity to a state of (d) where all the units of the hot water supply devices 11 to 14 are operated at the maximum heating capacity.

Meanwhile, in the case where the hot water supply flow rate is reduced from the state of (d), for example, the heating capacity is preferentially reduced by reducing the opening degree of the hot water outlet flow rate adjustment valve 39 of the hot water supply device (third sub hot water supply device) whose operation is started last among the hot water supply devices in operation. In addition, in the case where the water supply flow rate of the third sub hot water supply device is less than the operation start flow rate (the operation stop condition is satisfied), the operation is stopped. By further reducing the heating capacity and reducing the heating capacity in an order opposite to the order of starting operation to reduce the number of operating units, through the states of (c) and (b) to the state of (a), in the case where the water supply flow rate of the main hot water supply device is less than the operation start flow rate, the hot water supply operation is ended. In the case where the hot water consumption increases/decreases during hot water supply as well, the heating capacity of the hot water supply device whose operation is started last, among the hot water supply devices in operation, is adjusted, and the number of operating units is changed in accordance with the additional operation condition, the operation stop condition.

In the state of (d) where the linked hot water supply system 10 supplies hot water with the maximum heating capacity, the opening degree of the hot water outlet flow rate adjustment valve 39 of the hot water supply device (third sub hot water supply device) whose operation is started last is at the maximum, and the opening degrees of the hot water outlet flow rate adjustment valves 39 of the multiple hot water supply devices whose operation is started earlier are respectively at maximum as well. Accordingly, there should be no difference among the water passing volume of the hot water supply devices in operation. By using this, in the case where the opening degree of the hot water outlet flow rate adjustment valve 39 of the hot water supply device whose operation is started last is at the maximum, the system control device 15 makes a determination on blockage of the inlet water filter 33 by comparing the water passing volumes of the hot water supply devices in operation. In addition, a hot water supply device whose inlet water filter 33 is determined as blocked is reported through, for example, a display or a sound output of the operation remote controller 15*a*.

The blockage determination on the inlet water filter 33 by the system control device 15 is described based on the flowchart of FIG. 5.

The blockage determination is started as the hot water supply operation starts, and in S21, whether the opening degree of the hot water outlet flow rate adjustment valve 39 (water volume adjustment valve) of the hot water supply device whose operation is started last is at the maximum is determined. Since a determination on the blockage may be carried out in a state in which the water passing volume is stable, a determination may be made on whether the opening degree of the hot water outlet flow rate adjustment valve 39 is at the maximum and a predetermined time has passed. In the case where the determination of S21 is NO, the flow returns to S21, and in the case where the determination of S21 is YES, the flow proceeds to S22.

In S22, the water passing volumes of all of the hot water supply devices in operation are respectively obtained, and the flow proceeds to S23. In S23, a reference value is set for the hot water supply device as a blockage determination target based on the obtained water passing volumes, and the flow proceeds to S24. In the reference value, for example, the water passing volume of the hot water supply device one unit prior to the start of operation is set for the sub hot water supply device, and in the reference value of the main hot water supply device, for example, the water passing volume of the sub hot water supply device whose operation is started last is set. In addition, the reference value may also be a mean or a median of the water passing volumes of the hot water supply devices in operation, for example, in a recent measurement period, and may also be a mean or a median of the water passing volumes of other hot water supply devices excluding the hot water supply device as the blockage determination target, for example, in a recent measurement period. The hot water supply device as the blockage determination target is set one after another in order from the hot water supply devices as the operation candidates.

In S24, whether the water passing volume of the hot water supply device as the blockage determination target is equal to or greater than the reference value-a (a being a predetermined tolerance value set in advance) is determined. In the case where the determination of S24 is YES, the flow proceeds to S25. In S25, the blockage determination target is set as a hot water supply device whose water inlet filter 33 is not blocked and remains in the operation candidates, and the flow proceeds to S27. Meanwhile, in the case where the determination of S24 is NO, the flow proceeds to S26. In S26, the blockage determination target is set as a hot water supply device whose water inlet filter 33 is blocked and excluded from the operation candidates, and the flow proceeds to S27.

In S27, whether the blockage determination through comparing the water passing volumes on all of the hot water supply devices in operation is completed is determined. In the case where the determination of S27 is NO, the flow returns to S23, and in the case where the determination of S27 is YES, the blockage determination ends.

For example, in the case of comparing with a reference value set based on the specification of the hot water supply device, the comparison may be influenced by the water supply pressure of the tap water. However, since the determination is made by comparing the water passing volume with the reference value set in accordance with the setting environment based on the actual water passing volume, the influence of the water supply pressure can be eliminated. In addition, the blockage of the inlet water filter 33 can be detected to prompt a maintenance measure before the blockage of the inlet water filter 33 progresses to an extent that the hot water supply device is not operable.

The system control device 15 excludes the hot water supply device whose inlet water filter 33 is determined as blocked from the operation candidates, and performs the operating unit number control at the time of hot water supply operation. Accordingly, the situation where it is difficult to increase the water passing volume because of the blockage of the water inlet filter 33 and the additional operation condition cannot be satisfied can be prevented, and the number of operating units can be increased to increase the heating capacity. In addition, in the case where the closing valves are respectively provided between the water supply pipe 1 and the hot water supply devices 11 to 14, the closing valve of the hot water supply device whose inlet water filter 33 is determined as blocked can be closed for maintenance while allowing hot water supply usage.

The functions and effects of the linked hot water supply system 10 are described. The hot water supply devices 11 to 14 of the linked hot water supply system 10 each have the water passing volume detection means which detects the water passing volume of the tap water introduced from the water supply pipe 1. In the case where the hot water supply devices 11 to 14 are operating at the same time, the system control device 15 (control means) makes a determination on the blockage of the inlet water filter 33 installed to each of the introduction parts 29*a* of the tap water in the water supply paths 29 of the hot water supply devices 11 to 14 by comparing the water passing volumes of the hot water supply devices 11 to 14 that are operating.

Accordingly, by comparing the water passing volumes of the hot water supply devices 11 to 14 operating at the same time, the system control device 15 can determine that the inlet water filter 33 is blocked for a hot water supply device whose water passing volume is small. In addition, maintenance can be prompted for the hot water supply device whose inlet water filter 33 is determined as blocked.

The hot water supply devices 1 to 14 of the linked hot water supply system 10 each include the hot water outlet flow rate adjustment valve 39 (water volume adjustment means). Among the hot water supply devices 11 to 14 in operation, in the case where the opening degree of the hot water outlet flow rate adjustment valve 39 of the hot water supply device whose operation is started last is at the maximum, since the opening degrees of the hot water outlet flow rate adjustment valves 39 of all the hot water supply devices 11 to 14 in operation are at the maximum, the water passing volumes of the hot water supply devices 11 to 14 in operation should be equal. By using this point, a determination on the blockage of the inlet water filter 33 can be made for the hot water supply devices 11 to 14 in operation.

The system control device 15 removes the hot water supply device whose inlet water filter 33 is determined as blocked from the operation candidates and not operate the hot water supply device whose inlet water filter 33 is determined as blocked. Accordingly, the occurrence of an issue that the additional operation condition is not satisfied because the inlet water filter 33 is blocked and the heating capacity is insufficient can be prevented, and the number of operating units can be increased to increase the heating capacity in accordance with the hot water supply flow rate. In addition, it is possible to maintain the hot water supply device whose inlet water filter is determined as blocked without interfering with the hot water supply of other hot water supply devices.

In the determination on the blockage of the inlet water filter 33, the determination of being blocked may also be made in the case where the water passing volume does not satisfy a predetermined ratio with respect to a reference value. In the case where the hot water outlet flow rate adjustment valve 39 of the hot water supply device whose operation is started last is adjusted so that the heating capacities of the hot water supply devices in operation are equal, the determination on the blockage of the inlet water filter 33 can be performed with the hot water supply devices not in operation in the operation candidates being excluded. In addition, those skilled in the art can implement various modifications to the above embodiments without departing from the scope of the invention, and the invention includes such modifications.

What is claimed is:

1. A linked hot water supply system, comprising: a plurality of combustion hot water supply devices arranged in parallel between a water supply pipe and a hot water supply pipe; and a controller, configured to change a number of operated units of the hot water supply devices to adjust a heating capacity in accordance with a hot water consumption, wherein the hot water supply devices is each provided with a water supply flow rate sensor, a bypass flow rate adjustment valve, a hot water outlet flow rate adjustment valve and an inlet water filter installed to an introduction part of tap water from the water supply pipe, wherein the hot water outlet flow rate adjustment valve of each hot water supply device is configured to adjust the water passing volume of the respective hot water supply device by adjusting its opening degree during operation, wherein the controller is further configured to calculate a water passing volume of each hot water supply device based on a detected flow rate of the water supply flow rate sensor, an opening degree of the bypass flow rate adjustment valve, and an opening degree of the hot water outlet flow rate adjustment valve, wherein when the hot water supply devices are operating at a same time and an opening degree of the hot water outlet flow rate adjustment valve of a last operated hot water supply device among the hot water supply devices in operation is at maximum, the controller makes a determination on blockage of the inlet water filter installed in each of the hot water supply devices by comparing the water passing volumes of the hot water supply devices in operation.

2. The linked hot water supply system as claimed in claim 1, wherein the controller excludes a hot water supply device in which the inlet water filter is determined as blocked among the hot water supply devices from operation candidates.

3. The linked hot water supply system as claimed in claim 1, wherein the controller excludes a hot water supply device in which the inlet water filter is determined as blocked among the hot water supply devices from operation candidates.

* * * * *